US009704660B2

(12) United States Patent
Wuerfel et al.

(10) Patent No.: US 9,704,660 B2
(45) Date of Patent: Jul. 11, 2017

(54) ELECTRICAL SWITCHING DEVICE, WHICH SWITCHES STROKE-DEPENDENTLY, WITH EXTENDED SWITCHING HYSTERESIS

(71) Applicant: ABB TECHNOLOGY AG, Zurich (CH)

(72) Inventors: Lothar Wuerfel, Grosskrotzenburg (DE); Matthias Schmidt, Frankfurt (DE); Joachim Bohlaender, Grosskrotzenburg (DE)

(73) Assignee: ABB Schweiz AG, Baden (CH)

( * ) Notice: Subject to any disclaimer, the term of this patent is extended or adjusted under 35 U.S.C. 154(b) by 11 days.

(21) Appl. No.: 14/688,580

(22) Filed: Apr. 16, 2015

(65) Prior Publication Data

US 2015/0221455 A1 Aug. 6, 2015

Related U.S. Application Data

(63) Continuation of application No. PCT/EP2013/003133, filed on Oct. 18, 2013.

(30) Foreign Application Priority Data

Oct. 18, 2012 (DE) ..... 10 2012 020 395
Jun. 25, 2013 (DE) ..... 10 2013 010 496

(51) Int. Cl.
*H01H 3/42* (2006.01)
*H01H 3/30* (2006.01)
(Continued)

(52) U.S. Cl.
CPC ..... *H01H 3/301* (2013.01); *H01H 3/42* (2013.01); *H01H 3/46* (2013.01); *H01H 33/34* (2013.01)

(58) Field of Classification Search
CPC ..... H01H 33/34; H01H 13/18; H01H 13/562; H01H 3/301; H01H 3/42; H01H 3/46
(Continued)

(56) References Cited

U.S. PATENT DOCUMENTS 3,497,647 A * 2/1970 Wintriss ..... H01H 13/18 200/61.41
4,716,812 A 1/1988 Koerner et al.
2011/0168533 A1 7/2011 Bohlander

FOREIGN PATENT DOCUMENTS

DE 34 08 909 A1 9/1985
DE 103 26 715 B3 12/2004
(Continued)

OTHER PUBLICATIONS

International Search Report (PCT/ISA/210) mailed on Jan. 31, 2014, by the European Patent Office as the International Searching Authority for International Application No. PCT/EP2013/003133.

*Primary Examiner* — Edwin A. Leon
*Assistant Examiner* — Ahmed Saeed
(74) *Attorney, Agent, or Firm* — Barnes & Thornburg LLP

(57) ABSTRACT

The disclosure relates to an electrical switching device, which switches stroke-dependently, with extended switching hysteresis, including a switching element with a contact lever, the switching element cooperating with an actuating element movably guided in a holding device. The actuating element has a step-shaped portion for actuating the contact lever of the switching element and the actuating element has an opening in which an engagement element designed as a bolt or a pin engages when a switching action is initiated. The opening provided in the actuating element is formed as an elongated hole, in which the engagement element engages in order to achieve a switching stroke and a defined
(Continued)

hysteresis is thus set depending on the design of the elongated hole.

11 Claims, 4 Drawing Sheets

(51) Int. Cl.
*H01H 33/34* (2006.01)
*H01H 3/46* (2006.01)

(58) Field of Classification Search
USPC ..... 200/524, 329
See application file for complete search history.

(56) References Cited

FOREIGN PATENT DOCUMENTS

| | | | |
|---|---|---|---|
| DE | 10 2008 035 871 | A1 | 2/2010 |
| EP | 0 829 892 | A1 | 3/1998 |
| EP | 2 313 901 | B1 | 1/2012 |

* cited by examiner

ELECTRICAL SWITCHING DEVICE, WHICH SWITCHES STROKE-DEPENDENTLY, WITH EXTENDED SWITCHING HYSTERESIS

RELATED APPLICATION(S)

This application claims priority as a continuation application under 35 U.S.C. §120 to PCT/EP2013/003133, which was filed as an International application on Oct. 18, 2013 designating the U.S., and which claims priority to Germany Applications 10 2012 020 395.0 filed in Germany on Oct. 18, 2012 and 10 2013 010 496.3 filed in Germany on Jun. 25, 2013. The entire contents of these applications are hereby incorporated by reference in their entireties.

FIELD

The disclosure relates to an electrical switching device, which switches stroke-dependently, with extended switching hysteresis and a hydraulic spring energy store drive for a medium-voltage or high-voltage circuit breaker, which includes a spring excursion switch including the switching device.

BACKGROUND INFORMATION

Hydraulic spring energy store drives for actuating high-voltage circuit breakers are known, for example, from DE 3408909 A1 and EP 0829892 A1 and can include, inter alia, a storage module for actuating a high-voltage switch including a spring element acting as an energy store. The spring element interacts with a movable storage piston guided in a hydraulic block. The storage module is intended for providing pressure energy to the hydraulic drive of the high-voltage circuit breaker without any further supply of external energy and for actuating the drive and, thereby, the circuit breaker correctly, even in the event of a fault or an interruption to the energy supply.

The state of stress of the spring element can be monitored constantly via a spring excursion switch. Owing to the reloading of the hydraulic pump integrated in the spring energy store drive which sometimes occurs in order to compensate for low internal pressure losses in the hydraulic system of the spring energy store drive, even without any preceding switching operation, permanent self-monitoring of the drive function of the spring energy store drive can be ensured even in the case of long standstill times.

EP 2 313 901 B1 describes a spring energy store drive whose spring element, also referred to below as storage spring, pressurizes a fluid, for example oil, located in the storage cylinder via a pressure body and a pressure piston which is movable in sliding fashion in a storage cylinder. A drive rod which is fastened on a drive piston, which is movable in sliding fashion in a working cylinder, is moved by this fluid.

During a switching operation, a certain quantity of oil is removed from the storage module and thus the spring element is relieved of tension. In order to determine the loading state of the spring energy store drive, a spring excursion switch can be used, which is mechanically connected to the spring element. If the drive or working piston moves with the drive or working rod into a first end position, it closes the circuit breaker. If the working piston is moved with the working rod into a second end position, it opens the circuit breaker.

Depending on the spring stress of the spring element, bistable actuating or contact elements are actuated via a gear mechanism arrangement, which actuating or contact elements are intended, for example, to inhibit switching operations when insufficient switching energy is stored in the spring element, for example owing to internal leakage losses in the hydraulic system of the spring energy store drive.

One of the provided contact elements serves the purpose of controlling the motor of the spring energy store drive for reloading of the storage module. If the spring excursion of the storage module in the form of a spring element falls below a preset value, the motor is switched on and tensions the spring element up to a switch-off point which is above this value. The difference between the switch-off point and the switch-on point of the motor is also referred to as reloading hysteresis and results from hysteresis in the switching operation of the bistable contact elements.

The spring excursion switches used in known hydraulic spring energy store drives use the hysteresis of the switching contacts themselves to achieve reloading hysteresis. As is shown in FIG. 1, the switching contacts are moved, for this purpose, by an actuating element 20 with a cam, referred to below as actuating cam 21, wherein the cam can have a two-step configuration for this purpose.

Owing to the two-step configuration of the actuating cam 21, the switching hysteresis of the spring excursion switch is adjustable by virtue of an actuating or contact lever 11 of a switching element 10 of the spring excursion switch, which actuating or contact lever is guided via the actuating cam 21, remaining for a stroke 23 of the actuating cam 21 which is to be defined precisely in a position 22, which is between the switch-on and switch-off points of the switching element. This arrangement can only be used when the switching hysteresis of the switching element used, i.e. the differential distance between the switch-on and switch-off points, is sufficiently great. For example when small and therefore generally inexpensive switching elements are used, this switching hysteresis is generally extremely small. An increase in the hysteresis of the entire system can often only be implemented technically with a large amount of complexity, or not at all, when using a two-step actuating cam.

SUMMARY

An electrical switching device is disclosed, for switching stroke-dependently, with extended switching hysteresis, comprising: a holding apparatus; a movable actuating element guided in the holding apparatus; and a switching element having a contact lever, for interacting with the actuating element; wherein the actuating element has a step-shaped section for actuating the contact lever of the switching element, and the actuating element has an opening, in which an engagement element engages when a switching operation is triggered, wherein the actuating element is moved linearly along a movement axis by a movement of the engagement element, wherein the opening provided in the actuating element is a slot, into which the engagement element engages so as to achieve a switching stroke setting a defined hysteresis depending on the configuration of the slot.

BRIEF DESCRIPTION OF THE DRAWINGS

The further description of the disclosure and advantages thereof and configurations thereof is set forth below on the basis of the drawings, in which.

DETAILED DESCRIPTION

Figure 1:
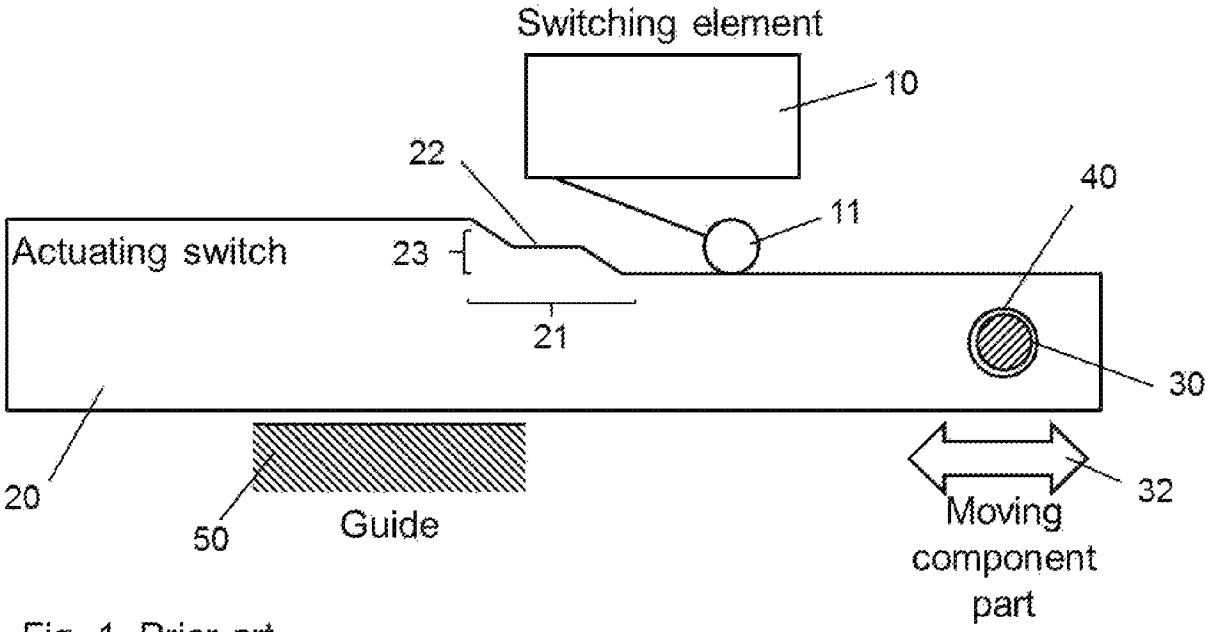
Fig. 1 Prior art
FIG. 1 shows a switching device having switching hysteresis of a spring excursion switch in accordance with the prior art.

Exemplary embodiments of the disclosure can increase the hysteresis of a mechanically actuated electrical switching device, wherein a small and inexpensive switching element with a small dedicated switching hysteresis can be used. Furthermore, exemplary embodiments of the disclosure relate to a hydraulic spring energy store drive for a medium-voltage or high-voltage circuit breaker, which includes a spring excursion switch including the switching device according to the disclosure.

The switching device according to exemplary embodiments of the disclosure, for delayed switch-on of the spring excursion switch of a hydraulic spring energy store drive, includes a switching element including a contact lever, which interacts with a movable actuating element guided in a holding apparatus. The actuating element can have a step-shaped section, also referred to as actuating cam, for providing a switching stroke for the contact lever of the switching element and therefore for actuating the contact lever of the switching element. Furthermore, an opening can be provided in the actuating element, into which opening an engagement element, for example in the form of a bolt or pin, engages when a switching operation triggered in order to actuate the above-described hydraulic system of the spring energy store drive, and thus a defined hysteresis can be set depending on the configuration of the slot.

In accordance with an exemplary embodiment of the disclosure, the opening provided in the actuating element can be in the form of a slot, as a result of which the engagement element does not engage in a hole with a precise fit but in a slot which can be enlarged by the preset switching hysteresis in order to achieve the switching stroke. Thus, despite a precise switching point of the switching element, a defined hysteresis can be set depending on the configuration of the slot. In this case, the bolt or pin slides along the slot and a switching operation can be implemented when the engagement element has reached its end position in the slot.

In an exemplary embodiment of the disclosure, the movable actuating element restricted in terms of its movement by a friction force braking apparatus, also referred to below as friction brake, in terms of its movement. The frictional force can be in this case so great that possible external disruptive forces cannot overcome this frictional force and a malfunction of the switching device according to an exemplary embodiment of the disclosure can be prevented. It is therefore ensured that a movement of the actuating element can be effected exclusively by the movement of the engagement element.

A spring excursion switch according to an exemplary embodiment of the disclosure can include a switching device having a switching hysteresis as described above, wherein the switching device switches on a pump for delivering fluid from a low-pressure tank into the high-pressure receiver, for example when insufficient switching energy can be stored in the spring element, which was caused by internal leakage losses in the hydraulic system of the spring energy store drive.

A hydraulic spring energy store drive according to an exemplary embodiment of the disclosure, for actuating a high-voltage or medium-voltage circuit breaker can include a storage element for generating pressure in a high-pressure receiver and a spring excursion switch including a switching device, as described above.

The switching device interacts with the storage element, which can be in the form of at least one plate spring or helical spring, in such a way that the contact lever of the switching element switches on a hydraulic pump when reloading, for example owing to internal pressure losses in the hydraulic system of the spring energy store drive, of the state of tension of the spring element can be initiated and, for this purpose, fluid can be delivered from a low-pressure tank into the high-pressure receiver depending on the switching hysteresis provided.

FIG. 1 shows, schematically, a known switching device which can be used in a spring excursion switch and which uses the hysteresis of the switching contact. The switching device includes a switching element 10 having a contact lever 11, which interacts with a movable actuating element 20 guided in a holding apparatus 50. The actuating element 20 can have a two-step section, also referred to as actuating cam 21.

Furthermore, an opening 40 can be provided in the actuating element 20, with an engagement element 30, for example in the form of a bolt or pin, engaging in the opening in order to generate a movement of the actuating element 20 along a movement axis 32, the engagement element therefore actuating the hydraulic system of the spring energy store drive.

The two-step outer contour of the actuating cam 21 of the actuating element 20 which determines a delay of the switch-on or switch-off of the switching element 10 can be arranged on that side of the actuating element 20 which faces the switching element 10 and the contact lever 11 and enables the contact lever 11 to remain, for a stroke 23 to be defined precisely, in a position which can be located between the switch-on and switch-off points of the switching element 10.

In FIG. 1, the actuating element 20 can be moved linearly along the movement axis 32 by a movement of the engagement element 30. The outer contour of the actuating cam 21 can be configured in such a way that three plateaus or planar surfaces are produced parallel to the movement axis 32, which plateaus or planar surfaces have spacing from the movement axis 32 which are different from one another. The plateaus are arranged spaced apart from one another in the axial direction, in relation to the movement axis 32. The two regions between the plateaus are in this case configured as ramps in each case, along which the contact lever 11 can be guided during a movement of the actuating element 20.

Corresponding to the configuration of the outer contour of the actuating cam 21, the switching hysteresis can be adjustable by virtue of the outer contour determining the adjustment of the contact lever 11 with which the hysteresis inherent to the switching element 10 can be approached in a targeted manner, i.e. with which stroke 23 or for what duration of the movement in the direction of the movement axis 32 the contact lever 11 can be located in the position 22 on the central of the three plateaus. If the hysteresis inherent to the switching element 10 can be very low, however, for example in the case of inexpensively produced, simple and small switching elements, the actuating element 20 configured with a two-step actuating cam 21 cannot be used for the required reloading hysteresis of a hydraulic spring energy store drive of a circuit breaker, for example of a high-voltage switchgear assembly.

Figure 2:
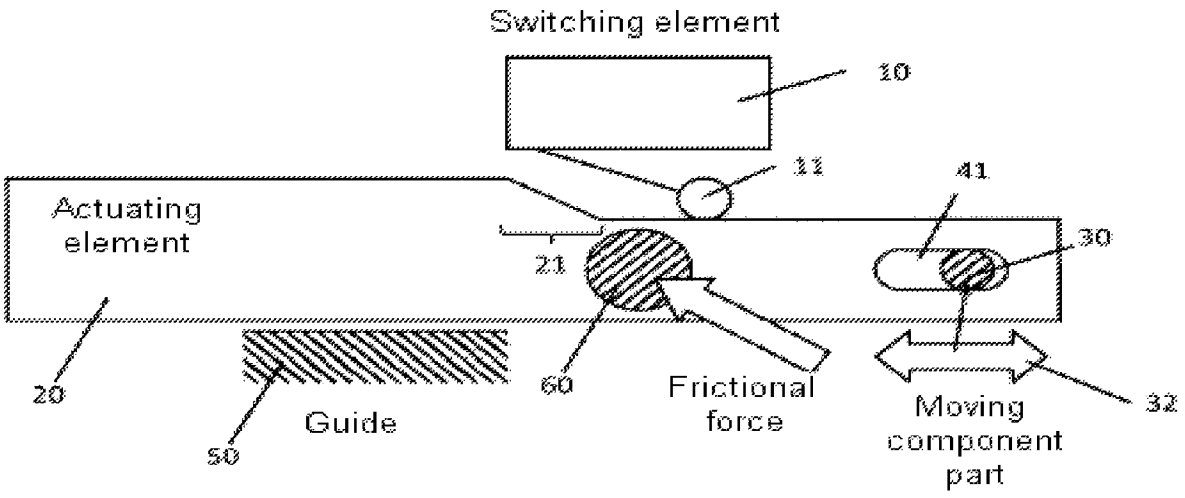
FIG. 2 shows an exemplary embodiment of the switching device according to the disclosure with increased switching hysteresis for a spring excursion switch.

In order to achieve a desired extended switching hysteresis in the case of circuit breakers, it can be proposed in accordance with an exemplary embodiment of the disclosure for the opening 41 provided in the actuating element 20 to be in the form of a slot, as illustrated in FIG. 2. The actuating element 20 of the electrical switching device according to an exemplary embodiment of the disclosure which switches stroke-dependently with extended switching hysteresis for delayed switch-on of a spring excursion switch of a hydraulic spring energy store drive for monitoring the loading state of the storage module of the drive can have a step-shaped section. The step-shaped section can have one step, in the case of a switching element with a precise switching point, as shown in FIG. 2, or else two steps, as shown in FIG. 1, in the case of a switching element with a small dedicated hysteresis. The actuating element 20 again interacts with a contact lever 11 of the switching element 10, which can be guided in a suitable manner through the outer contour of the actuating element 20. In turn, the opening 41 can be provided in the actuating element 20, with the engagement element 30, for example in the form of a bolt or pin, engaging in the opening in order to move the actuating element 20 and therefore in order to actuate the hydraulic system.

In the exemplary embodiment of the disclosure shown in FIG. 2, the interaction between the moving engaging element 30, the movable actuating element 20 and the movable contact lever 11 corresponds to that described in connection with FIG. 1. The difference is that the actuating cam 21 in this case only can have a single step, with the result that only two plateaus arranged parallel to the movement axis 32 result, which correspond to the switch-on and, respectively, switch-off point of the switching element 10, in this case formed with a precise switching point without any dedicated hysteresis. Furthermore, the opening 41 provided in the actuating element 20 can be in the form of a slot, in contrast to FIG. 1, as a result of which the engagement element 30 does not engage in a hole with a precise fit but in the slot 41, which can be enlarged by the desired hysteresis. Thus, despite the use of an inexpensive switching device with either a precise switching point or with only a small switching hysteresis, optimum pre-defined switching hysteresis of the entire system can be set depending on the configuration of the slot 41.

In an exemplary embodiment of the disclosure, the movable actuating element 20 can be restricted in terms of its movement by an arrangement 60 in the form of a friction force brake. The frictional force of the arrangement 60 can be in this case so great that possible external disruptive forces cannot overcome the friction force brake 60, and a malfunction of the switching device according to the disclosure can be prevented.

The friction force brake 60 can be constructed from at least one braking element, preferably manufactured from plastic, in combination with a spring element. By virtue of the arrangement of the friction force brake between the actuating element 20 and the fixed holding apparatus 50, the friction resulting during a movement of the actuating element 20 can be applied in an advantageous manner.

Figure 3:
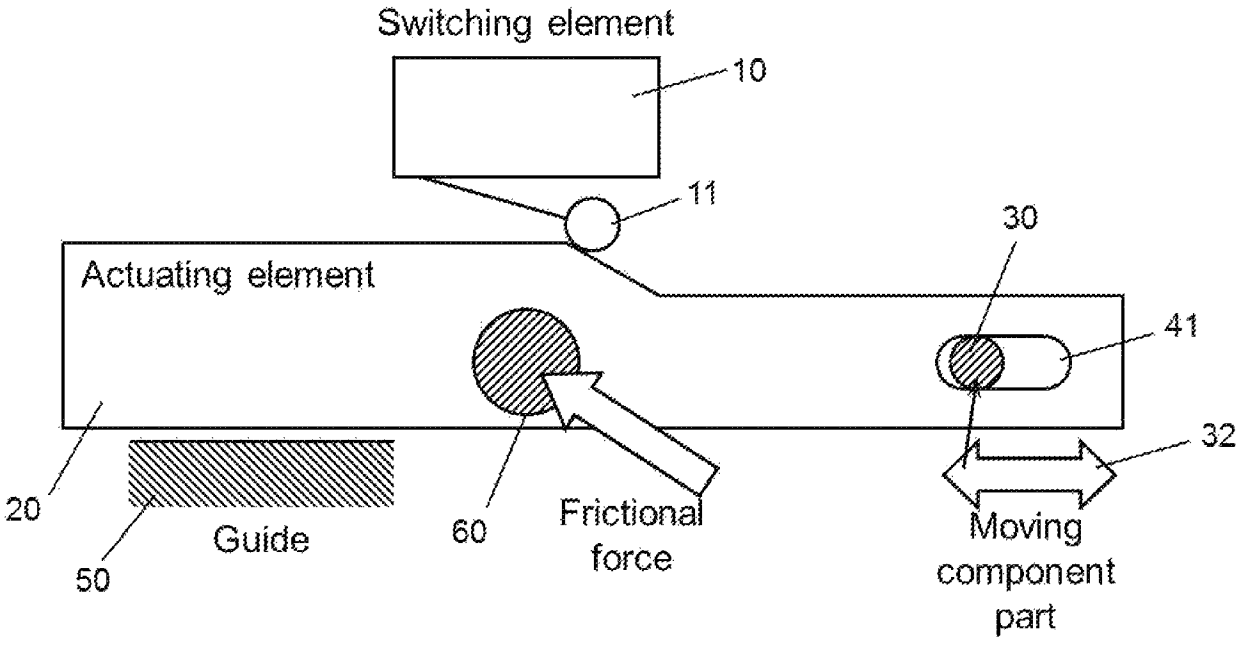
FIG. 3 shows the exemplary embodiment of the switching device of FIG. 2 in a different configuration.

FIG. 3 illustrates the switching device of FIG. 2 in a different configuration. As shown in FIG. 3, the actuating element 20 has moved linearly along the movement axis 32 by a movement of the engagement element 30 within the slot 41, such that a defined hysteresis is achieved depending on the configuration of the slot 41. As the engagement element 30 moves along the movement axis 32, the actuating element 20 interacts with the contact lever 11 of the switching element 10, which is guided in a suitable manner along the outer contour of the actuating element 20.

Figure 4:
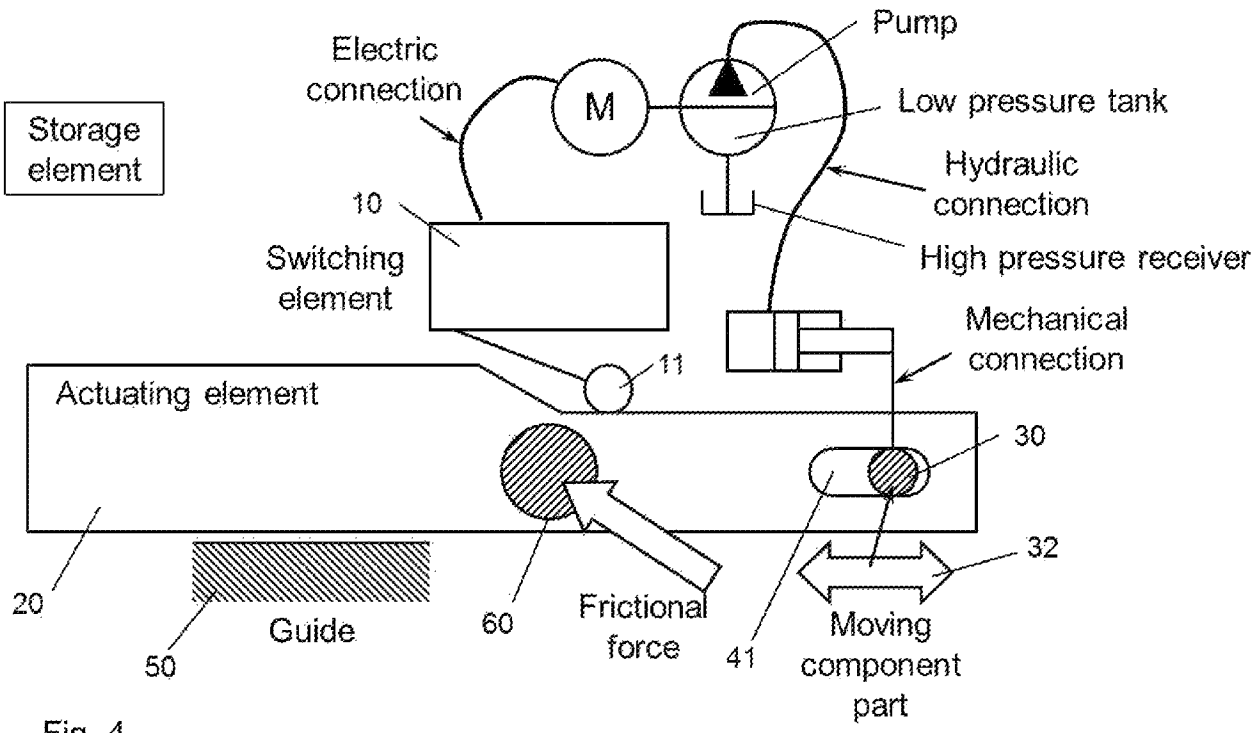
FIG. 4 shows a system schematic of an exemplary embodiment of a hydraulic system incorporating the switching device of FIG. 2.

Referring now to FIG. 4, a system schematic of a hydraulic spring energy store drive for actuating a high-voltage or medium-voltage circuit breaker is shown. The interaction between the moving engagement element 30, the movable actuating element 20, and the movable contact lever 11 corresponds to that described in connection with FIG. 2. FIG. 4 further illustrates the switching device having a pump, a lower pressure tank, and a storage element for generating pressure in a high-pressure receiver. It should be appreciated that the switching device is configured to interact with the storage element in such a way that the switching element 10 of the switching device will switch on the pump for delivering fluid from the low-pressure tank into the high-pressure receiver depending on the switching hysteresis.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Switching element
11 Contact lever
20 Movable actuating element
21 Actuating cam, step-shaped section on the surface of the actuating element
30 Engagement element, bolt, pin
40 Opening in the actuating element
41 Slot
50 Guide for the actuating element, holding apparatus
60 Friction braking apparatus, friction force brake, spring for braking the actuating element

What is claimed is:

1. An electrical switching device for switching stroke-dependently with extended switching hysteresis, the device comprising:

a holding apparatus;

a movable actuating element guided in the holding apparatus; and a switching element having a contact lever for interacting with the actuating element;

wherein the actuating element has a step-shaped section for actuating the contact lever of the switching element, wherein the actuating element has an opening in which an engagement element engages when a switching operation is triggered, wherein the actuating element is moved linearly along a movement axis by a movement of the engagement element, and wherein the opening provided in the actuating element is a slot into which the engagement element engages so as to achieve a defined hysteresis depending on the configuration of the slot, the slot having a dimension along the movement axis that is larger than a dimension of the slot perpendicular to the movement axis.

2. The switching device as claimed in claim 1, further comprising:

a friction force brake for braking movement of the movable actuating element.

3. The switching device as claimed in claim 1, wherein the engagement element is a bolt or pin.

4. A spring excursion switch comprising:

the switching device having switching hysteresis as claimed in claim 1, wherein the switching device is configured for switching on a pump for delivering fluid from a low-pressure tank into a high-pressure receiver.

5. A hydraulic spring energy store drive for actuating a high-voltage or medium-voltage circuit breaker, comprising:

a storage element for generating pressure in a high-pressure receiver; and a spring excursion switch including a switching device as claimed in claim 1, wherein the switching device is configured to interact with the storage element in such a way that the switching element of the switching device will switch on a pump for delivering fluid from a low-pressure tank into the high-pressure receiver depending on the switching hysteresis.

6. The electrical switching device of claim 1, wherein the slot is an elongated slot.

7. The electrical switching device of claim 1, wherein the dimension of the slot along the movement axis is larger than a dimension of the engagement element along the movement axis.

8. The electrical switching device of claim 1, wherein the slot is configured such that the engagement element moves a predetermined distance along the movement axis within the slot before the actuating element is moved linearly along the movement axis by the engagement element.

9. The electrical switching device of claim 1, wherein the step-shaped section of the actuating element includes only one ramp surface.

10. The electrical switching device of claim 7, wherein the dimension of the slot along the movement axis is at least twice as long as the dimension of the engagement element along the movement axis.

11. The electrical switching device of claim 1, wherein the dimension of the slot along the movement axis is at least twice as long as the dimension of the slot perpendicular to the movement axis.

* * * * *